US008870245B2

(12) United States Patent
Johnson et al.

(10) Patent No.: US 8,870,245 B2
(45) Date of Patent: Oct. 28, 2014

(54) LATCH RECEIVER FOR HOOK LATCH

(75) Inventors: Matthew Johnson, Chicago, IL (US); Sergio Meza, Lyons, IL (US)

(73) Assignee: L & P Property Management Company, South Gate, CA (US)

( * ) Notice: Subject to any disclaimer, the term of this patent is extended or adjusted under 35 U.S.C. 154(b) by 595 days.

(21) Appl. No.: 12/916,520

(22) Filed: Oct. 30, 2010

(65) Prior Publication Data

US 2012/0104771 A1 May 3, 2012

(51) Int. Cl.
*E05C 3/06* (2006.01)

(52) U.S. Cl.
USPC ..... 292/197; 292/340; 292/341.14

(58) Field of Classification Search
USPC ..... 292/95, 340 X, 341, 341.14 X, 128, 101, 292/136, 102, 108
See application file for complete search history.

(56) References Cited

U.S. PATENT DOCUMENTS 1,361,702 A * 12/1920 Falls ..... 292/123
1,671,328 A * 5/1928 Sturm et al. ..... 292/162
3,596,954 A * 8/1971 Hull et al. ..... 292/128
3,784,727 A 1/1974 Haubein
4,926,662 A 5/1990 Gaudet
5,275,028 A 1/1994 Giarrante
5,477,710 A 12/1995 Stefanutti
5,875,659 A 3/1999 Nosse
6,196,034 B1 3/2001 Diebold et al.
6,494,064 B1 12/2002 Pena
6,578,393 B2 6/2003 Yarborought
6,679,533 B1 1/2004 Bruner et al.
7,278,284 B1 10/2007 James
7,634,878 B1 12/2009 Motosko

* cited by examiner

*Primary Examiner* — Mark Williams

(74) *Attorney, Agent, or Firm* — Shook, Hardy & Bacon, L.L.P.

(57) ABSTRACT

A latch receiver for receiving the hook of a hook latch has a metal C-shaped outer guard cover with parallel spaced apart side panels defining an open end that is a little wider than the width of the spaced apart sides of the latch enclosure. The C-shaped guard cover further has a planar back panel from which the side panels extend. Within the guard cover and spaced from the back panel is a rectangular receiver plate. Above and below the receiver plate are upper and lower end plates that support the receiver plate.

9 Claims, 7 Drawing Sheets

LATCH RECEIVER FOR HOOK LATCH

The present invention relates to locks for protective barriers, and in particular to a hook latch receiver to mate with an enclosure for a hook latch to protect the workings of the mortise and latch against contaminants and tampering.

BACKGROUND OF THE INVENTION

It is often desirable to section off portions of the workplace that may contain dangerous equipment, expensive equipment, or sensitive equipment that is easily damaged. Protective barriers and enclosures are also used to section off portions of a work space that may expose the individual to unusual or unexpected dangers, such as high electrical voltage, liquefied gasses, and radiation. It is desirable that the partitions for sectioning off protected areas be attractive in appearance, easy to assemble, rigid, and difficult to compromise.

An important part of such partitions is the provision of a gate allowing access to and from the protected area, and a lock for locking the gate. The lock must have sufficient strength such that it will not fail when subjected to tampering or brute force. The lock assembly must also have a sufficiently long life expectancy to survive for many years.

Locksets are generally either a hook latch, in which a hook is extended from the mortise as the latch is operated with the hook engaging a bar on a receiver. Such hook latches are particularly desirable for sliding doors and gates where the hook retains the sliding member from being withdrawn from the receiver. Alternately, a lockset may include a slam latch, such as a deadbolt in which an elongate member extends from the mortise and is received in a transverse opening in the receiver. Such slam latches are particularly desirable for swinging doors and gates in which the transverse opening retains the slam latch, or deadbolt, to prevent the gate or door from swinging.

Hook lock mortises having the physical strength to retain such gates are readily available in the art; however, such locks must be mounted in an enclosure that mates with a suitable latch plate so that the lock will withstand outside contaminants, tampering, and brute force to which such locks are inevitably subjected. Accordingly, there is a need for an enclosure a suitable latch plate for use with a hook lock.

BRIEF DESCRIPTION OF THE INVENTION

Briefly, the present invention is embodied in a latch receiver for receiving the hook of a hook latch that is enclosed in a metal container having parallel spaced apart sides and a planar forward surface from which the hook of the latch extends.

In accordance with the invention, the latch receiver includes a metal C-shaped outer guard cover including parallel spaced apart side panels defining an open end that is a little wider than the width of the spaced apart sides of the latch enclosure. The C-shaped guard cover further has a planar back surface from which the side panels extend.

Positioned within the C-shaped guard cover is a receiver plate including a central body portion and upper and lower end portions, the central portion extending parallel to and spaced a short distance forward from the back surface of the C-shaped guard cover. The upper and lower end portions contact the back surface of the C-shaped guard cover and are welded thereto.

Between the central body portion and the end portions are shield plates that support the central body and obstruct access to the central body by a tampering tool. The shield plates also space the central body of the latch plate from the latch enclosure.

BRIEF DESCRIPTION OF THE DRAWINGS

A better understanding of the invention will be had after a reading of the following detailed description taken in conjunction with the drawings wherein.

DETAILED DESCRIPTION OF PREFERRED EMBODIMENT

Figure 1:
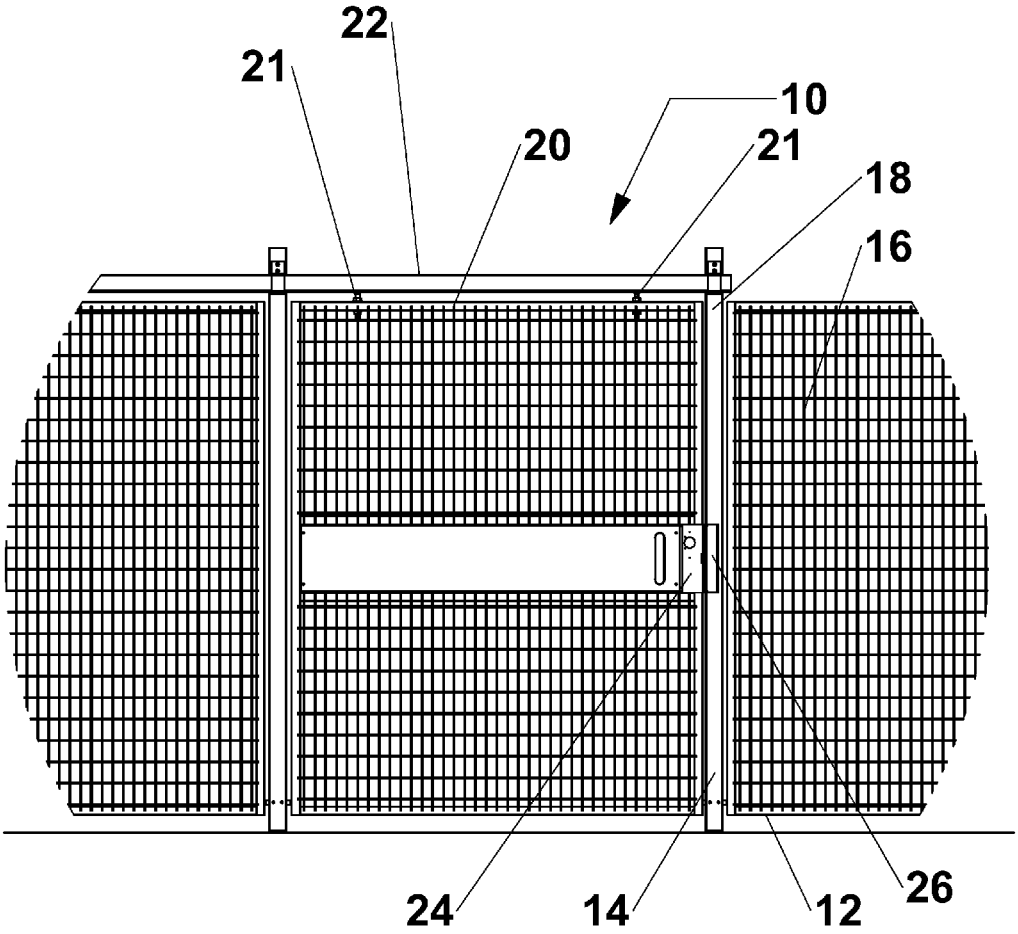
FIG. 1 depicts a barrier having a gate with a lock in an enclosure in accordance with the present invention.
Figure 2:
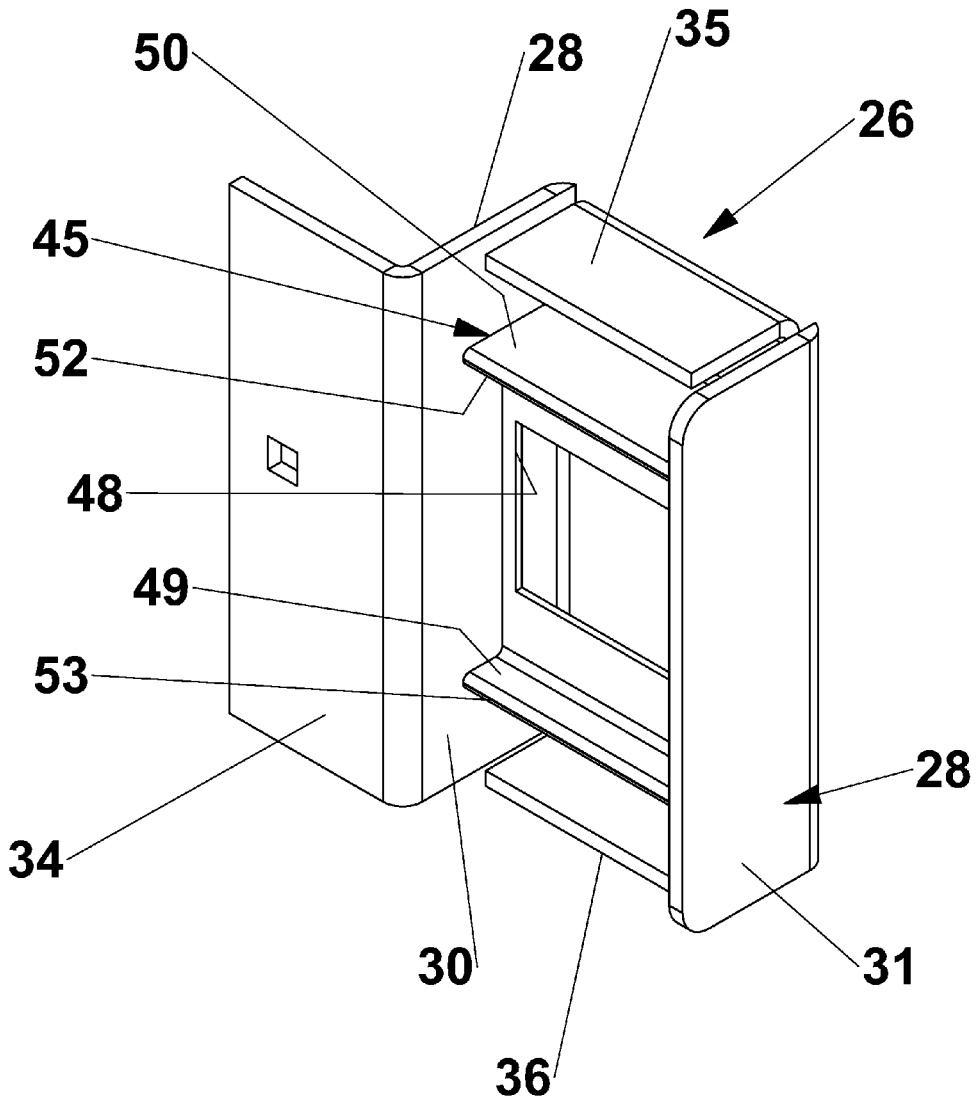
FIG. 2 is an isometric view of a hook latch receiver in accordance with the present invention.
Figure 5:
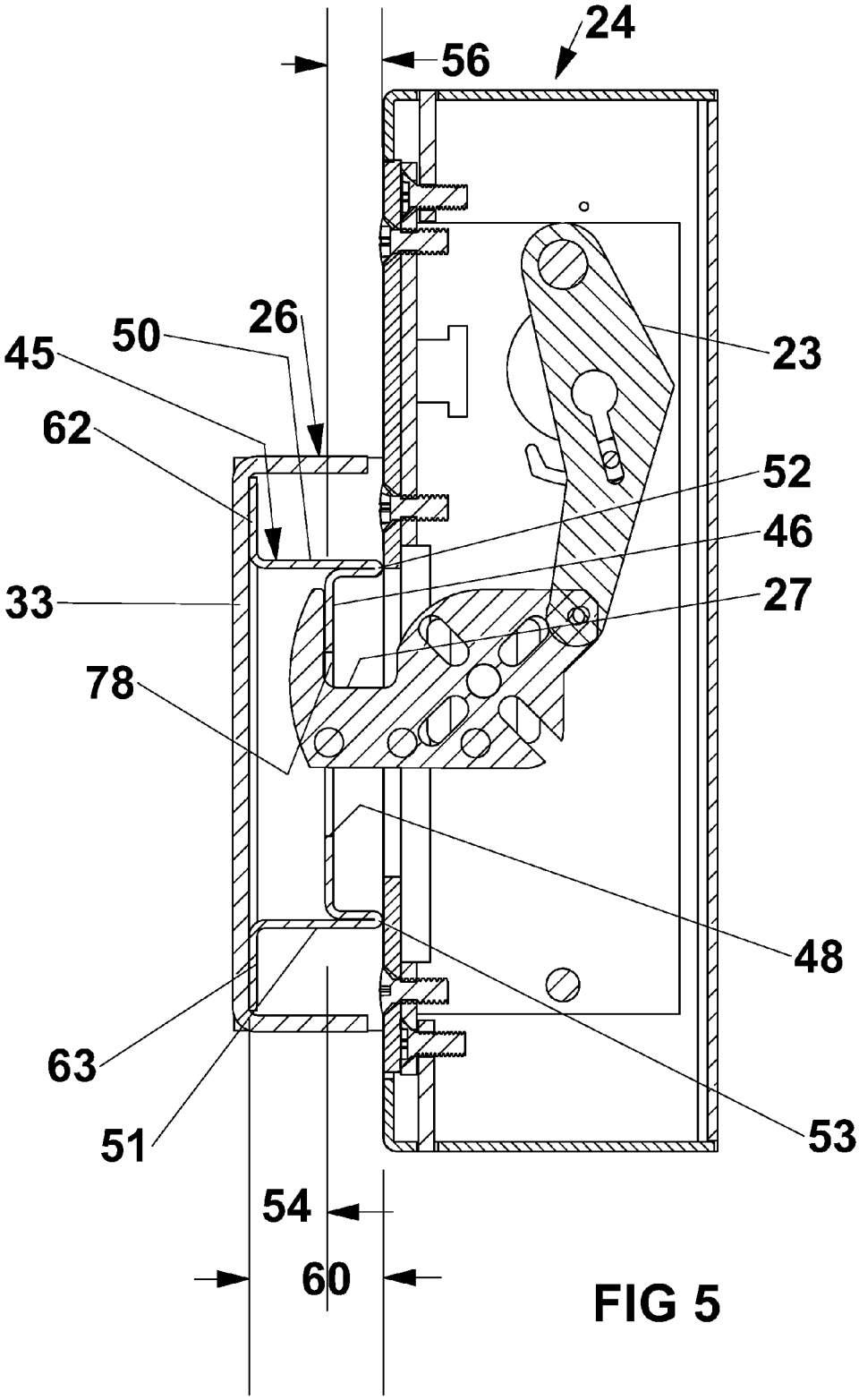
FIG. 5 is a cross-sectional view of the latch plate shown in FIGS. 2 and 3, the hook latch enclosure and hook latch mortise taken through line 5-5 of FIG. 4.

Referring to FIGS. 1 and 5, a protective barrier 10 for sectioning off a portion of a premises includes a barrier section 12 having a plurality of vertically standing support members 14 and a steel mesh 16 that extends between the support members 14 to prevent entry into the protected area. The barrier 10 also includes an opening 18 for making entry through the barrier 10 and a gate 20 for closing the opening 18. Gate 20 may be pivoted on hinges for rotatably closing against the opening 18 or may have wheels 21 for rolling on a track 22 for slideably closing the opening 18. To retain the gate 20 enclosed against the opening 18, a lock mortise 23 including a lock cylinder are fitted within an enclosure 24. The mortise 23 includes a latch that engages a lock receiver 26 positioned along an edge of the barrier 10. When the gate 20 is slideable, the latch is a hook latch 27 and the lock receiver 26 has a crossbar therein that is engaged by the hook 27 of the latch to prevent the gate 20 from being retracted along the rails.

Referring to FIGS. 2 through 7, to avoid failure of the lock as a result of tampering, the lock receiver 26 must mate with the lock enclosure 24 in such a manner as to obstruct access by a tool or other device which could reach into the receiver 26 to the latch 27 and thereby compromise the lock.

A latch receiver 26 in accordance with the present invention includes a C-shaped guard covers 28 having generally parallel side panels 30, 32 and joining parallel spaced ends on each side of the side panels 30, 32 a planar back panel 33 that extends generally perpendicular to the side panels 30, 32. In the preferred embodiment, the guard cover further includes upper and lower end panels 35, 36 which enhance the appearance of the latch receiver and obstruct a tampering tool from reaching the hook 27. To retain the shell 28 to a support member 14 on the barrier 10, the receiver 26 further includes a mounting panel 34 that joins a forward end of one of the side panels 30.

Figure 6:
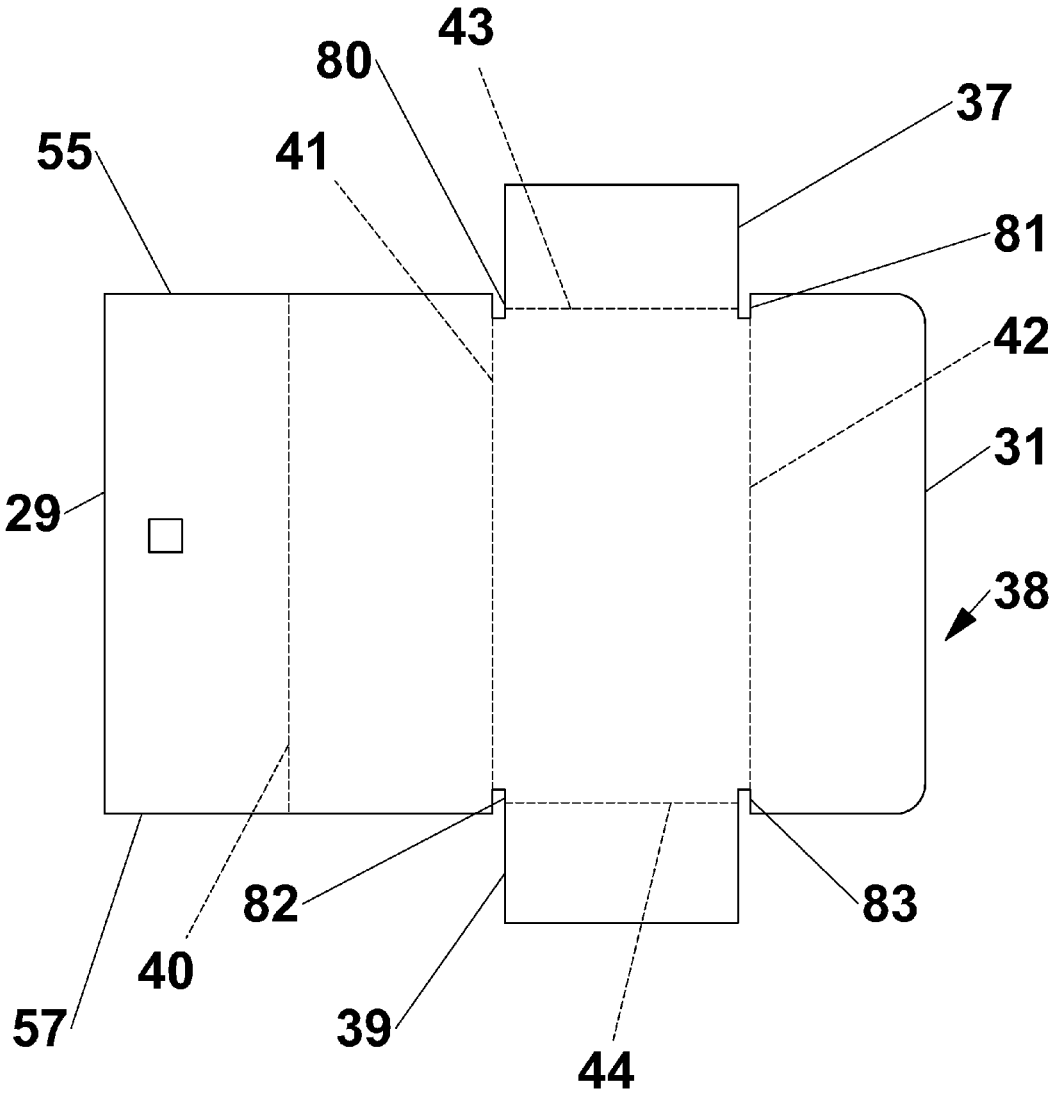
FIG. 6 is a plan view of a plate from which the guard cover for the latch receiver shown in FIG. 2 is formed.

As shown in FIG. 6, the guard cover 28 and the mounting panel 34 are formed of a single generally rectangular metal plate 38 with parallel outer ends 29, 31 and parallel upper and lower ends 55, 57 oriented perpendicular to the outer ends 29, 31. Extending parallel to the outer ends 29, 31 are parallel folds 40, 41, 42 in the plate to thereby successively form the mounting panel 34, side panel 30, back panel 33, and side panel 32. The plate 38 also has an upper and a lower rectangular projections 37, 39 extending from the portion between folds 43 and 44 to form the upper and lower end panels 35, 36. Extending into the body of the panel 38 and along folds 41 and 42 are upper notches 80, 81 and lower notches 82, 83. The notches 80-83 form extensions to the outer edges of the projections 37, 39 respectively. Also, a pair of folds 43, 44 extend parallel to upper and lower ends 55, 57 respectively so as to define the inner edges of the projections 37, 39. The notches 80-83 are configured such that when the projections 37, 39 are folded ninety degrees at folds 43 and 44 with the surfaces of the projections 37, 39 parallel to each other they become the upper and lower end panels 35, 36. Preferably, the plate 38 is made of a high grade steel or the equivalent having sufficient thickness to retain rigidity and resist failure as the result of brute force or the like administered by a potential invader.

Figure 3:
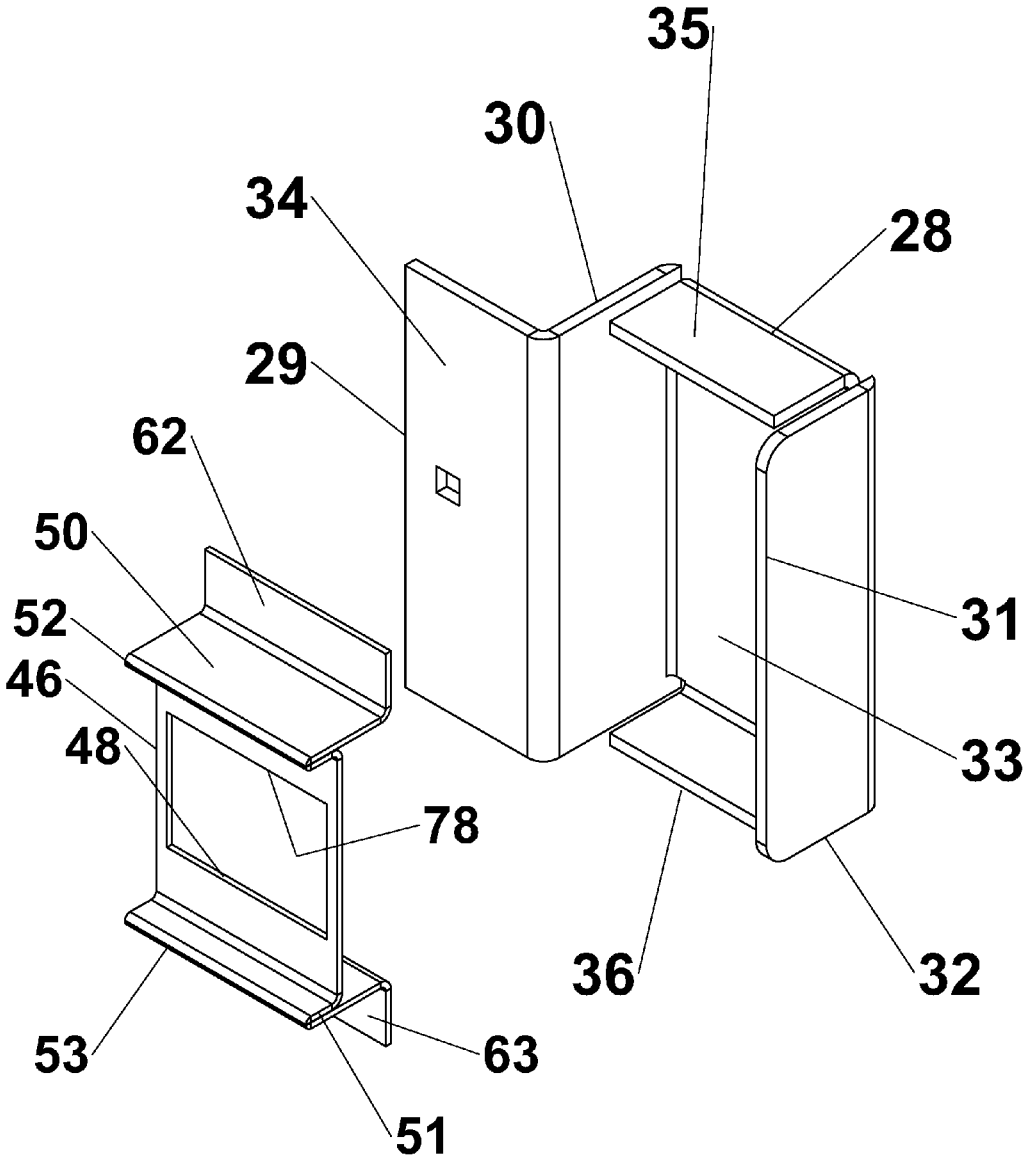
FIG. 3 is an exploded view of the hook latch receiver shown in FIG. 2.
Figure 7:
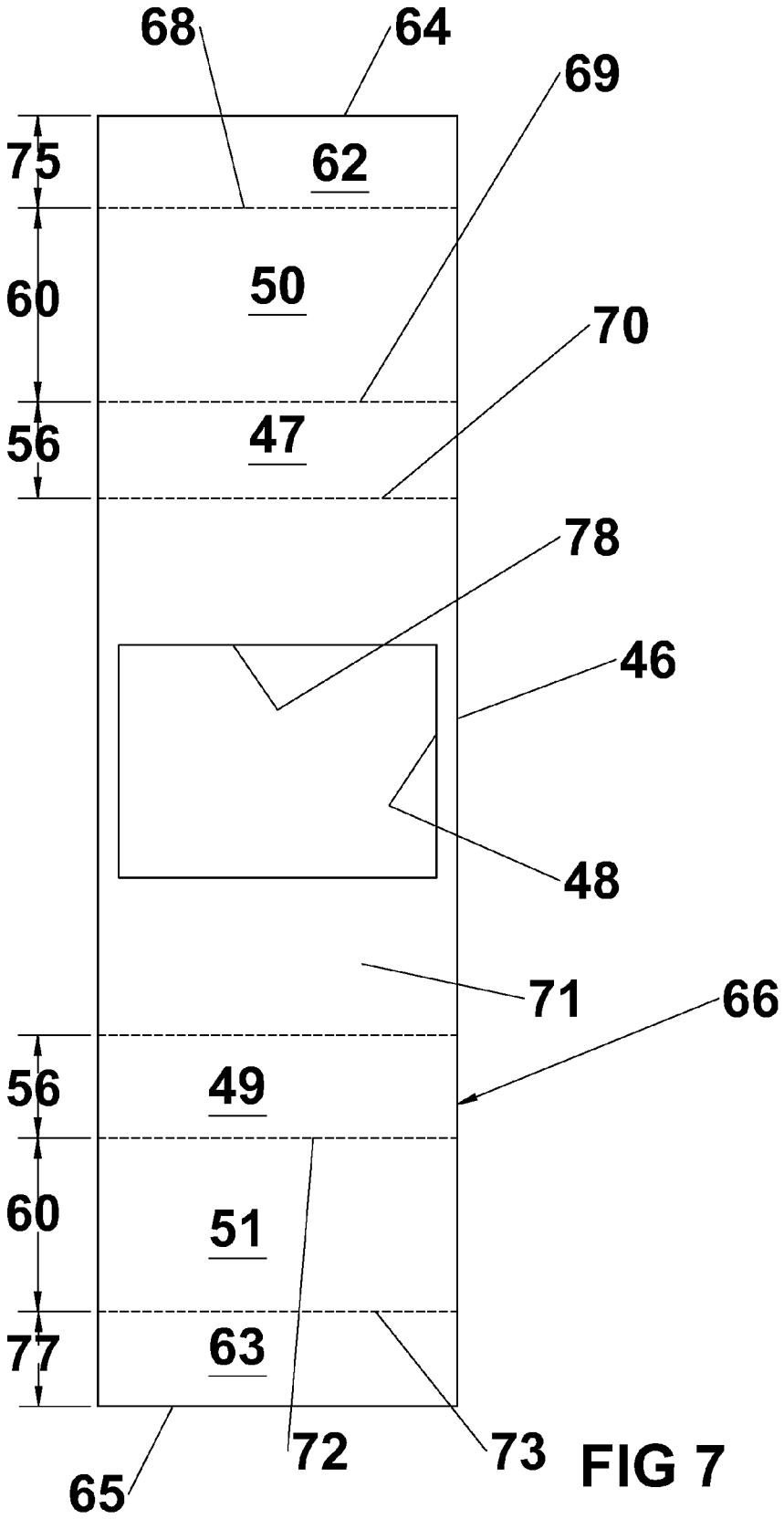
FIG. 7 is a plan view of a plate from which the latch plate of the latch receiver shown in FIG. 2 is formed.

Referring to FIGS. 3,5, and 7, fitted within the guard cover 28 is a latch plate 45 that includes a central panel 46 having a rectangular an aperture 48 therein with dimensions that are larger than the cross-sectional dimensions of the hook latch 27 adapted to be received therein. The aperture 48 includes an edge plate 78 suitable for receiving the hook 27. The central panel 46 is retained a short distance 54 forward of the back panel 33 by upper and lower end panels 50, 51, each of which includes a projection that extends forward of the central panel 46 a second short distance 56 to form upper and lower forward contact edges 52, 53 respectively. The contact edges 52, 53 formed by upper and lower end panels 50, 51 extend a third distance 60 forward of the surface of the back panel 33. Finally, the latch plate 45 includes upper and lower mounting panels 62, 63 oriented parallel to the central panel 46 and adapted to fit against the surface of the back panel 33. To provide a solid receiver for receiving the hook 27 of a hook latch, the upper and lower mounting plates 62, 63 are securely welded to the back panel 33.

Referring to FIG. 7, the latch plate 45 is made from a single rectangular plate 66 having parallel outer ends 64, 65 and folds 68, 69, 70, 71, 72, 73 therein. The folds 68-73 are parallel to each other and to the outer ends 64, 65 and the folds 68-73 form the steel plate 66 into the various portions of the latch plate 45. Accordingly, the first fold 68 is a right angle fold spaced a distance 75 from the first end 64 thereby forming an upper mounting panel 62. The second fold 69 is a one hundred and eighty degree fold spaced a distance 60 from the first fold 68 and thereby forming the upper end panel 50 and the upper contact edge 52. The third fold 70 is a right angle fold forming an upper spacing panel 47 spacing the central panel 46 the distance 56 from fold 69 and forming one side of the central panel 46. The fourth fold 71 is another right angle fold that defines the opposite side of the central panel 46 and forms one end of panel 49. Spaced the distance 56 from the fourth fold is the fifth fold 72, a one hundred and eighty degree fold that forms the other end of the lower spacing panel 49, the lower contact edge 53, and one edge of the lower end panel 51. Spaced the distance 60 from the fifth fold 72 is a sixth fold 73, a right angle fold defining the lower end of panel 51 and separating the panel 51 from the lower mounting plate 63. The sixth fold 73 is spaced a distance 77 from the second outer end 65.

An important feature of the present invention is that the upper and lower contact edges 52, 53 are adapted to make contact with the outer end of the lock enclosure 24 while the hook latch 27 is engaged over an edge 78 of the aperture 48 so as to leave a minimum of horizontal movement, or "play" between the latch enclosure 24 and the latch receiver 26. Keeping horizontal movement to a minimum inhibits the space accessible to a tampering tool and therefore protects the integrity of the lock. Also, the upper and lower end panels 50, 51 space the contact edges 52, 53 from the back panel 33 a distance 60 that is greater than the distance that the outer end of the hook 27 extends outward of the locking enclosure 24 thereby preventing the distal end of the hook 27 from contacting the rear panel 33 of the latch receiver 26. Where the distal end of the latch 27 is able to contact an inner surface of a latch receiver, the contact may interfere with the operation of the latch and result in the hook 27 failing to engage the edge 78 of the aperture 48. Such failures generally occur when the gate 20 is slammed hard against the latch receiver 26 allowing only a fraction of a second for the latch to engage the receiver. Any interruption with the movement of the hook 27 will prevent the hook from engaging the edge 78 and cause the gate 20 to bounce away from the receiver 26 without having become engaged thereto.

Another feature of the invention is that the length 75 of the upper mounting panel 62 and the length 77 of the lower mounting panel 63 are chosen so that the outer ends 64, 65 thereof will fit snuggly between the upper and lower end panels 35, 36 of the guard cover 28 thereby positioning the central panel 46 and the aperture 48 to receive the hook 27 of the latch.

Figure 4:
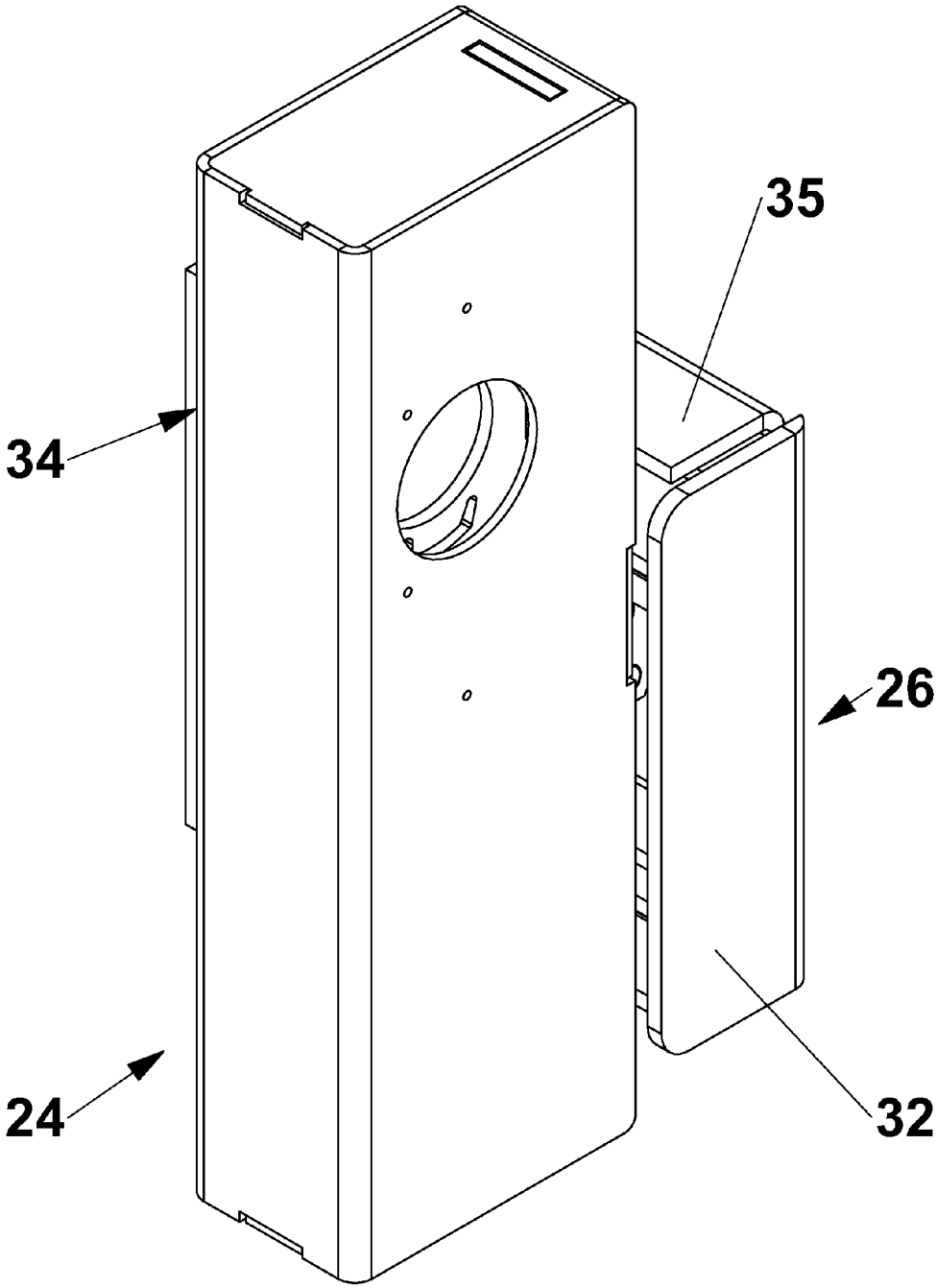
FIG. 4 is an isometric view of the latch plate shown in FIGS. 2 and 3 in engagement with a lock enclosure containing a hook latch.

Referring to FIGS. 4 and 5, another feature of the invention is that the side panels 30, 32 have an overall width that is a little greater than the spacing 60 of the upper and lower contact edges 52, 53 from the back panel 33. Accordingly, the outer ends 29, 31 of the side panels 30, 32 will overlap a portion of the sides of the lock enclosure 24 thereby providing further obstruction to access by a tampering tool.

As can be seen, a lock receiver 26 in accordance with the present invention, will obstruct tampering with the hook 27 that engages the central panel 46 thereof to securely retain a gate 20 against the lock receiver 26.

While the present invention has been described with respect to a single embodiment, it will be appreciated that many modifications and variations can be made without departing from the spirit and scope of the invention. It is therefore the intent of the appended claims to cover all such modifications and variations that fall within the spirit and scope of the invention.

What is claimed:

1. A latch receiver for receiving a hook of a hook latch and for mating with a latch enclosure comprising the hook of the hook latch, said latch receiver comprising:

a metal C-shaped guard cover having parallel sides, a planar back panel and an open end, wherein at least one of the parallel sides extends a first distance from the planar back panel, said open end having an inner width configured to mate with the latch enclosure, wherein the inner width is wider than an outer width of the latch enclosure; and a metal latch plate attached to said C-shaped guard cover, said latch plate comprising:

(1) upper and lower attachment portions for attachment to said planar back panel;

(2) a central portion for receiving said hook latch, said central portion spaced a second distance from said planar back panel;

(3) upper and lower end panels for spacing the central portion the second distance from the planar back panel; and (4) upper and lower contact surfaces corresponding to the upper and lower end panels, said upper and lower contact surfaces for contacting an outer surface of said latch enclosure, wherein each of said upper and lower contact surfaces is spaced from said planar back panel a third distance, wherein the third distance is greater than said second distance that said central portion is spaced from said planar back panel, wherein each of said upper and lower contact surfaces is separated from the central portion a fourth distance, wherein each of said upper and lower contact surfaces is configured to reduce play between said hook latch and said latch receiver.

2. The latch receiver of claim 1 wherein the first distance is greater than the second distance, and the at least one of said parallel sides of said metal C-shaped guard cover extending outward of a surface of said planar back panel comprises extending outward of said surface of said planar back panel towards the open end of the metal C-shaped guard cover, wherein a portion of said at least one of said parallel sides is configured to extend around a side of a latch enclosure mated with said latch receiver such that at least a portion of the one of said parallel sides overlaps a portion of a side of the latch enclosure mated with said latch receiver.

3. The latch receiver of claim 1 wherein said C-shaped guard cover includes an upper and a lower end panel, and said upper attachment portion of said latch plate extends adjacent to said upper end panel of said C-shaped guard cover and said lower attachment portion of said latch plate extends adjacent to said lower end panel of said C-shaped guard cover, wherein said upper and lower attachment portion have lengths sized to position said central portion of said latch plate with respect to said C-shaped guard cover for receiving said hook.

4. The latch receiver of claim 1 wherein:

said latch plate has a plurality of folds including a first fold separating said upper attachment portion from the upper end panel of said latch plate, a second fold forming the upper contact surface for contacting said latch enclosure, a third fold defining an upper end of said central portion, a fourth fold defining a lower end of said central portion, a fifth fold forming the lower contact surface for contacting said latch enclosure, and a sixth fold separating the lower end panel from said lower attachment portion.

5. A latch receiver for receiving a hook of a hook latch and for mating with a latch enclosure comprising the hook of the hook latch, said latch receiver comprising:

a metal C-shaped guard cover having parallel sides, a planar back panel and an open end, at least one of the parallel sides extending a first distance from the planar back panel, and a metal latch plate attached to said C-shaped guard cover, said latch plate comprising:

(1) upper and lower attachment portions for attachment to said planar back panel;

(2) a central portion for receiving said hook latch, said central portion spaced a second distance from said planar back panel and (3) at least one contact portion extending from said center portion of said latch plate, wherein said at least one contact portion extends a third distance from the planar back panel, wherein the at least one contact portion and the central portion are spaced apart a fourth distance.

6. The latch receiver of claim 5 wherein said open end has an inner width that is wider than an outer width of a latch enclosure mated with the latch receiver, such that at least a portion of the open end is configured to receive at least a portion of the latch enclosure, wherein said central portion of said latch plate is spaced from said planar back panel the second distance such that a hook extending from the hook latch of the latch enclosure is spaced a part a fifth distance from the planar back panel, and wherein one of said parallel sides of said metal C-shaped guard cover extends outward of a surface of said planar back panel the first distance such that the one of said parallel sides extends from said surface of said planar back panel towards the open end of the metal C-shaped guard cover, wherein a portion of said one of said sides is configured to extend around a side of said latch enclosure mated with said latch receiver such that at least a portion of the one of said parallel sides overlaps a portion of a side of the latch enclosure mated with said latch receiver.

7. A latch receiver for receiving a hook of a hook latch and for mating with a latch enclosure comprising the hook of the hook latch, said latch receiver comprising:

a metal C-shaped guard cover having parallel sides, a planar back panel and an open end; and a metal latch plate attached to said C-shaped guard cover, said latch plate comprising:

a central portion for receiving said hook latch, said central portion spaced from said planar back panel by a first distance, an upper side portion and a lower side portion, said upper and said lower side portions each having a first end contacting said planar back panel, said upper and said lower side portions each having a second end for contacting a latch enclosure, wherein each of said upper and lower side portions has a length longer than said first distance, wherein each second end of said upper and lower side portion comprises a contact surface, wherein said second ends are configured to space said central portion from said latch enclosure based at least in part on contact of each contact surface of said upper and lower side portions, wherein said central portion is spaced from said latch enclosure to reduce play between said hook latch and said latch receiver.

8. The latch receiver of claim 7 wherein said open end has an inner width that is wider than an outer width of the latch enclosure mated with the latch receiver, said central portion is spaced from said planar back panel a second distance, and one of said parallel sides extends outward of a surface of said planar back panel a third distance greater than said second distance, wherein extending outward of said surface of said planar back panel comprises extending from said surface of said planar back panel towards the open end of the metal C-shaped guard cover, wherein a portion of said one of said sides extends around a side of said latch enclosure mated with said latch receiver such that at least a portion of the one of said sides overlaps a portion of a side of the latch enclosure mated with said latch receiver.

9. A latch receiver for receiving a hook of a hook latch, said latch receiver comprising:

a metal C-shaped guard cover having parallel sides, a planar back panel and an open end; and a metal latch plate attached to said C-shaped guard cover, said latch plate having a plurality of folds including a first fold separating said upper attachment portion from an upper end panel of said latch plate, a second fold forming an upper contact surface for contacting said latch enclosure, a third fold defining an upper end to a central portion, said upper end of said central portion comprising an upper contact portion extending from a surface of said central portion, wherein said upper contact portion is configured to separate a surface of a latch enclosure from the central portion of the latch plate based at least in part on contact of the upper contact surface with the latch enclosure, wherein the upper contact portion is further configured to separate the central portion a first distance from the planar back panel and reduce play between said hook latch and said latch receiver, a fourth fold defining a lower end of said central portion, said lower end of said central portion comprising a lower contact portion extending from a surface of said central portion, wherein said lower contact portion is configured to separate the central portion the first distance from the planar back panel and reduce play between said hook latch and said latch receiver, a fifth fold forming a lower contact surface for contacting said latch enclosure, wherein said lower contact portion is configured to separate the surface of the latch enclosure from the central portion of the latch plate based at least in part on contact of the lower contact surface with the latch enclosure, and a sixth fold separating a lower end panel from said lower attachment portion, wherein the upper contact surface and the lower contact surface are spaced a second distance from the planar back panel, wherein the second distance is greater than the first distance.

* * * * *